US010882655B1

(12) United States Patent
Egnor

(10) Patent No.: US 10,882,655 B1
(45) Date of Patent: Jan. 5, 2021

(54) SELF-SUPPORTING TRASH BAG

(71) Applicant: Daniel Allen Egnor, Harvest, AL (US)

(72) Inventor: Daniel Allen Egnor, Harvest, AL (US)

( * ) Notice: Subject to any disclaimer, the term of this patent is extended or adjusted under 35 U.S.C. 154(b) by 366 days.

(21) Appl. No.: 15/969,300

(22) Filed: May 2, 2018

Related U.S. Application Data

(60) Provisional application No. 62/500,178, filed on May 2, 2017.

(51) Int. Cl.
*B65B 67/04* (2006.01)
*B65B 67/12* (2006.01)

(52) U.S. Cl.
CPC ..... *B65B 67/12* (2013.01)

(58) Field of Classification Search
CPC combination set(s) only.
See application file for complete search history.

(56) References Cited

U.S. PATENT DOCUMENTS 3,742,994 A * 7/1973 Pensak ..... B65F 1/02 383/3
4,164,970 A * 8/1979 Jordan ..... A45C 3/00 206/522
4,867,576 A * 9/1989 Boyd ..... B65B 67/1238 383/33
4,941,754 A * 7/1990 Murdock ..... B65F 1/14 206/522
5,314,250 A * 5/1994 Lee ..... B65D 33/14 383/104
5,445,274 A * 8/1995 Pharo ..... B65D 81/052 206/522
5,454,642 A * 10/1995 De Luca ..... B65D 81/052 206/522
5,755,329 A * 5/1998 Sadow ..... A45C 13/021 206/320
6,212,716 B1 * 4/2001 Logan, Jr. ..... A47G 9/1027 383/3
9,248,962 B2 * 2/2016 Warren ..... B65D 81/052
9,386,946 B2 * 7/2016 Ron ..... A61F 5/4556
2010/0303387 A1 * 12/2010 Dahlquist ..... B65D 81/022 383/3
2010/0306914 A1 * 12/2010 Ron ..... A47K 11/06 4/479

* cited by examiner

*Primary Examiner* — Monica E Millner
(74) *Attorney, Agent, or Firm* — Angela Holt; Bradley Arant Boult Cummings LLP

(57) ABSTRACT

Embodiments of a trash bag are disclosed. In one embodiment, the trash bag includes a flexible bag body and one or more inflatable chambers that extend along the flexible bag body. The inflatable chambers may be configured to hold the flexible bag body upright and maintain the top bag opening in an open position when the inflatable chambers are inflated. In this manner, the inflatable chambers can provide sufficient structural integrity so that a trash can is not needed to use the trash bag.

2 Claims, 4 Drawing Sheets

SELF-SUPPORTING TRASH BAG

RELATED APPLICATIONS

This application claims the benefit of provisional patent application Ser. No. 62/500,178, filed May 2, 2017, the disclosure of which is hereby incorporated herein by reference in its entirety.

FIELD OF THE DISCLOSURE

This disclosure relates generally to trash bags (a.k.a. trash can liners).

BACKGROUND

Trash bags are a ubiquitous means for collecting and disposing trash. They are generally flexible, cheap, and easily manipulated. However, trash bags lack structural integrity and are generally used to line the inside of a trash can. More specifically, previously known trash bags require a trash can in order for them to be easily filled with trash. Otherwise, if a trash can is not used, the trash bag is completely amorphous thereby making it difficult to fill the trash bag with trash and maintain the trash within the trash bag. This is a problem because trash cans are not always accessible to a user at every location (e.g., such as during many outdoor activities).

Accordingly, what is needed is a trash bag that can be easily filled without requiring a trash can.

SUMMARY

Embodiments of a trash bag are disclosed. In one embodiment, the trash bag includes a flexible bag body and one or more inflatable chambers that extend along the flexible bag body. The inflatable chambers may be configured to hold the flexible bag body upright and maintain the top bag opening in an open position when the inflatable chambers are inflated. In this manner, the inflatable chambers can provide sufficient structural integrity so that a trash can is not needed to use the trash bag.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

Throughout this disclosure, relative terminology, such as "approximately," "substantially," "proximate," "near," and the like, may be used in a predicate to describe features and relationships between features of a device or method. The relative terminology in the predicate should be interpreted sensu lato. However, whether the predicate employing the relative terminology is satisfied is determined in accordance to error ranges and/or variation tolerances that are relevant to the predicate and allow the feature or related features described by the predicate to perform their intended function.

It should be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

This disclosure relates generally to trash bags for disposing waste. The trash bags include flexible bag bodies, which can be made from amorphous materials. However, inflatable chambers are provided that extend along the flexible bag bodies so that when the inflatable chambers are inflated the flexible bag body takes and is held in a specific shape (e.g., generally the shape of some type of container) that allows the trash bag to be easily filled. Thus, the trash bags do not need to line a trash can but, rather, the inflatable chambers provide the trash bags with the structural integrity needed to hold them upright and open.

Figure 1:
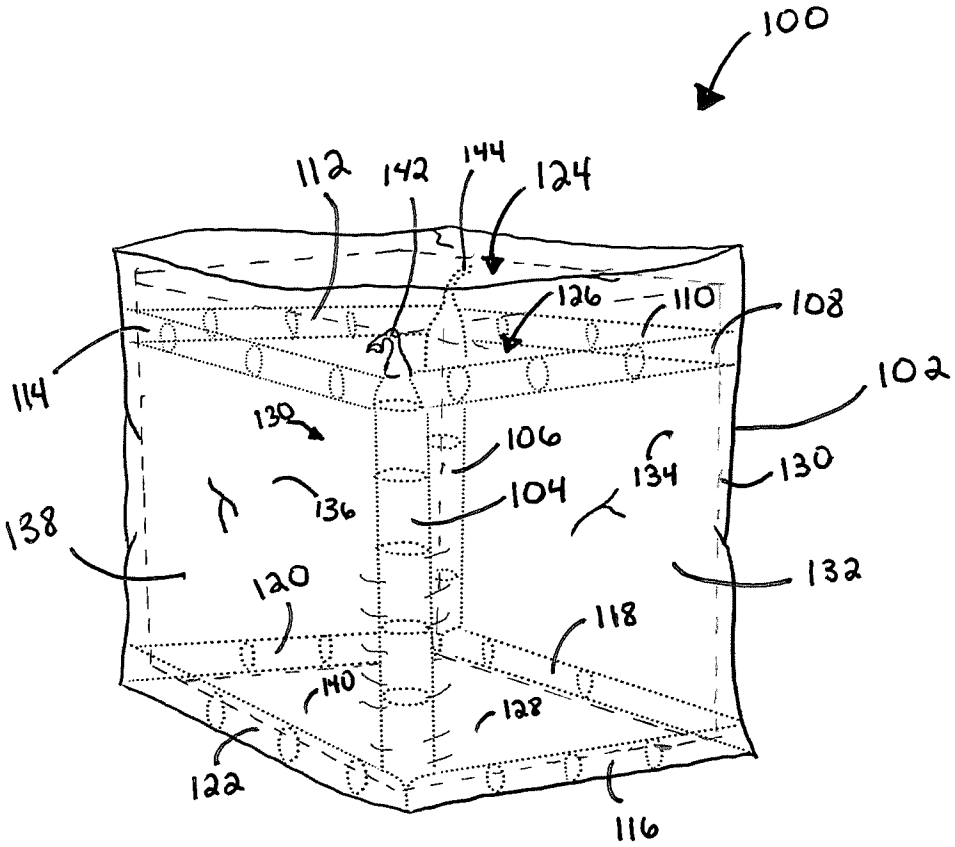
FIG. 1 illustrates one example of a trash bag in accordance with this disclosure.

FIG. 1 illustrates exemplary trash bag 100 in accordance with this disclosure. The trash bag 100 has a flexible bag body 102 and one or more inflatable chambers. In this embodiment, the trash bag 100 includes ten inflatable chambers 104, 106, 108, 110, 112, 114, 116, 118, 120, and 122. Each of the inflatable chambers 104, 106, 108, 110, 112, 114, 116, 118, 120, and 122 extends along the flexible bag body 100 so that the inflatable chambers 104, 106, 108, 110, 112, 114, 116, 118, 120, and 122 hold the flexible bag body 102 upright when the inflatable chambers 104, 106, 108, 110, 112, 114, 116, 118, 120, and 122 are inflated. In FIG. 1, the inflatable chambers 104, 106, 108, 110, 112, 114, 116, 118, 120, and 122 are shown inflated. Thus, the trash bag 100 is supported by the inflatable chambers 104, 106, 108, 110, 112, 114, 116, 118, 120, and 122 in a specific shape, which depends on the configuration of the inflatable chambers 104, 106, 108, 110, 112, 114, 116, 118, 120, and 122 along the flexible bag body 100. In this manner, the trash bag 100 does not need to be a liner in a trash can. Instead, the inflatable chambers 104, 106, 108, 110, 112, 114, 116, 118, 120, and 122 hold the flexible bag body 102 upright and open when the inflatable chambers 104, 106, 108, 110, 112, 114, 116, 118, 120, and 122 are inflated and thus trash can easily be thrown into the trash bag 100 without further support from a trash can.

It should be noted that, while this configuration of the trash bag 100 includes the ten inflatable chambers 104, 106, 108, 110, 112, 114, 116, 118, 120, and 122, different embodiments of the trash bag 100 may include any number of inflatable chambers. Furthermore, the specific configuration of the inflatable chambers 104, 106, 108, 110, 112, 114, 116, 118, 120, and 122 allow the flexible bag body 102 to take a specific shape, as explained in further detail below. However, different inflatable chambers may be provided in different configurations so that the flexible bag body 102 circumscribes an interior volume of any desired shape when the inflatable chambers are inflated.

In this embodiment, the specific shape is a rectangular cuboid. More specifically, as shown in FIG. 1, the flexible bag body 102 defines a top bag opening 124 that opens into an interior 126 of the flexible bag body 102 and a closed bag bottom 128 oppositely disposed from the top bag opening 124. In this manner, trash can be placed into the flexible bag body 102 through the top bag opening 124 and stored in the trash bag 100. Thus, maintaining the top bag opening 124 in the open position is important in order for trash to be easily placed and stored in the trash bag 100.

In this embodiment, the inflatable chambers 104, 106, 108, 110, 112, 114, 116, 118, 120, and 122, are configured to hold open the top bag opening 124 when the inflatable chambers 104, 106, 108, 110, 112, 114, 116, 118, 120, and 122 are inflated. Furthermore, the inflatable chambers 104, 106, 108, 110, 112, 114, 116, 118, 120, and 122 are configured to support the flexible bag body 102 when the inflatable chambers 104, 106, 108, 110, 112, 114, 116, 118, 120, and 122 are inflated such that the flexible bag body 102 circumscribes an interior volume 130 with a specific shape, which as mentioned above, is a rectangular cuboid.

To do this, the inflatable chamber 104 extends vertically along the flexible bag body 102. In addition, the inflatable chamber 106 extends vertically along the flexible bag body 102 and is oppositely disposed from the inflatable chamber 104. In this specific embodiment, the inflatable chamber 104 and the inflatable chamber 106 are provided at diagonally opposite vertical corners of the rectangular cuboid. In this manner, the inflatable chamber 104 and the inflatable chamber 106 provide much of the structural integrity needed to hold the flexible bag body 102 upright when the inflatable chambers 104, 106, 108, 110, 112, 114, 116, 118, 120, and 122 are inflated.

As shown in FIG. 1, the inflatable chambers 108, 110, 112, 114 extend horizontally along the flexible bag body 102 near the top bag opening 124. The inflatable chambers 108, 114 open into each other and thus each form one continuous inflatable chamber that extends around a portion of the perimeter of a cross sectional area of the flexible bag body 102 near the top bag opening 124. The inflatable chambers 110, 112 open into each other and thus each form one continuous inflatable chamber that extends around another portion of the perimeter of the cross sectional area of the flexible bag body 102 near the top bag opening 124. In this example, the cross sectional area is a square. Additionally, the ends of the inflatable chambers 112, 114 next to each other are closed so that the inflatable chambers 112, 114 are sealed off from one another. Furthermore, the ends of the inflatable chambers 108, 110 next to each other are closed so that the inflatable chambers 108, 110 are sealed off from one another.

The inflatable chambers 108, 110, 112, 114 thus provide a set of the inflatable chambers 108, 110, 112, 114 that hold open the top bag opening 124 when the inflatable chambers 108, 110, 112, 114 are inflated. Furthermore, with the specific configuration of the inflatable chambers 108, 110, 112, 114 shown in FIG. 1, the inflatable chambers 108, 110, 112, 114 maintain a structural integrity that provides the cross sectional area of the top bag opening 124 as a square when the inflatable chambers 108, 110, 112, 114 are inflated.

In FIG. 1, the inflatable chamber 104 open into inflatable chambers 108, 114 and the inflatable chamber 106 opens into the inflatable chambers 110, 112. However, due to the closed ends of the inflatable chambers 108, 110, 112, 114, the inflatable chamber 104 and the inflatable chamber 106 are sealed off from one another. In alternative the inflatable chamber 104 and the inflatable chamber 106 both open into the inflatable chambers 108, 110, 112, 114 so that the inflatable chambers 104, 106, 108, 110, 112, 114 are all continuous. In this embodiment, an open end of the inflatable chamber 108 and an open end of the inflatable chamber 114 are connected to a top open end of the inflatable chamber 104. Similarly, an open end of the inflatable chamber 110 and an open end of the inflatable chamber 112 are connected to a top open end of the inflatable chamber 106.

Furthermore, as shown in FIG. 1, the inflatable chambers 116, 118, 120, 122 extend horizontally along the flexible bag body 102 near the closed bag bottom 128. The inflatable chambers 116, 122 open into each other and thus each form one continuous inflatable chamber that extends around a portion of a perimeter of a cross sectional area of the flexible bag body 102 near the closed bag bottom 128. The inflatable chambers 118, 120 open into each other and thus each form one continuous inflatable chamber that extends around another portion of a perimeter of a cross sectional area of the flexible bag body 102 near the closed bag bottom 128. In this example, the cross sectional area is a square. The inflatable chambers 116, 118, 120, 122 thus provide a set of the inflatable chambers 116, 118, 120, 122 that maintain the closed bag bottom 128 shaped like a square when the inflatable chambers 116, 118, 120, 122 are inflated. Additionally, the ends of the inflatable chambers 116, 118 next to each other are closed so that the inflatable chambers 116, 118 are sealed off from one another. Furthermore, the ends of the inflatable chambers 120, 122 next to each other are closed so that the inflatable chambers 120, 122 are sealed off from one another.

In FIG. 1, the inflatable chamber 104 open into inflatable chambers 116, 122 and the inflatable chamber 106 opens into the inflatable chambers 118, 120. However, due to the closed ends of the inflatable chambers 108, 110, 112, 114, the inflatable chamber 104 and the inflatable chamber 106 are sealed off from one another. In alternative embodiments, the inflatable chamber 104 and the inflatable chamber 106 both open into the inflatable chambers 116, 118, 120, 122 so that the inflatable chambers 104, 106, 116, 118, 120, 122 are all continuous. In this case, an open end of the inflatable chamber 116 and an open end of the inflatable chamber 122 are connected to a bottom open end of the inflatable chamber 104. Similarly, an open end of the inflatable chamber 118 and an open end of the inflatable chamber 120 are connected to a bottom open end of the inflatable chamber 106.

Note that, given the configuration of the inflatable chambers 104, 106, 108, 110, 112, 114, 116, 118, 120, and 122, the flexible bag body 102 forms panels 132, 134, 136, 138 between the inflatable chambers 104, 106, 108, 110, 112, 114, 116, 118, 120, 122 that provide the vertical faces of the rectangular cuboid when the inflatable chambers 104, 106, 116, 118, 120, 122 are inflated. Furthermore, the closed bag bottom 128 forms a bottom panel 140 at the bottom face of the rectangular cuboid when the inflatable chambers 116, 118, 120, 122 are inflated. The top face of rectangular cuboid does not have a panel but rather is the top bag opening 124 held open with the square cross sectional area when the 108, 110, 112, 114 are inflated.

Nozzles 142, 144 are provided to inflate the inflatable chambers 104, 106, 108, 110, 112, 114, 116, 118, 120, 122. In this case, the nozzles 142, 144 are each shaped as spouts and can be used by a human to inflate the inflatable chambers 104, 106, 108, 110, 112, 114, 116, 118, 120, 122. In this embodiment, the inflatable chambers 104, 108, 114, 116, 122 are sealed off and separate from the inflatable chambers 106, 110, 112, 118, 120. Since the inflatable chambers 104, 108, 114, 116, 122, are continuous and open into each other, the nozzle 142 is used to inflate this only this subset of inflatable chambers 104, 108, 114, 116, 122. Furthermore, since the inflatable chambers 106, 110, 112, 118, 120, are continuous and open into each other, the nozzle 144 is used to inflate this only this subset of inflatable chambers 106, 110, 112, 118, 120. Each of the nozzles 142, 144 is shaped such that a user can tie the nozzles 142, 144 once the inflatable chambers 104, 106, 108, 110, 112, 114, 116, 118, 120, 122 are inflated.

In alternative embodiments, all of the inflatable chambers 104, 106, 108, 110, 112, 114, 116, 118, 120, 122 open into each other and thus both nozzles 142, 144 can be used to inflate all of the inflatable chambers 104, 106, 108, 110, 112, 114, 116, 118, 120, 122. In other embodiments, other subsets of the inflatable chambers 104, 106, 108, 110, 112, 114, 116, 118, 120, 122 may not be continuous and thus different nozzle arrangements may be needed to inflate the inflatable chambers 104, 106, 108, 110, 112, 114, 116, 118, 120, 122.

As discussed above, when the inflatable chambers 104, 106, 108, 110, 112, 114, 116, 118, 120, 122 are inflated, the inflatable chambers 104, 106, 108, 110, 112, 114, 116, 118, 120, 122 provide the structural integrity that holds the flexible bag body 102 in a specific shape (e.g., the rectangular cuboid). However, when the inflatable chambers 104, 106, 108, 110, 112, 114, 116, 118, 120, 122 are deflated, the flexible bag body 102 may be shaped amorphously. In this manner, the trash bag 100 can be sold in continuous rolls of trash bags, like the trash bag 100, which is highly spatially efficient.

More specifically, the flexible bag body 102 may be formed from one or more amorphous materials such that the interior volume 126 circumscribed by the flexible bag body 102 is shaped amorphously when the inflatable chambers 104, 106, 108, 110, 112, 114, 116, 118, 120, 122 are deflated. For example, the flexible bag body 102 may be formed from one or more amorphous plastic films, such as polyurethane films. Consequently, when the inflatable chambers 104, 106, 108, 110, 112, 114, 116, 118, 120, 122 are deflated, the panels 132, 134, 136, 138, 140 are not formed and the top bag opening 124 is not held open. Rather, the flexible bag body 102 takes an amorphous shape. However, once a user decides to use the trash bag 100, the inflatable chambers 104, 106, 108, 110, 112, 114, 116, 118, 120, 122 are inflated through the nozzles 142, 144 so that the inflatable chambers 104, 106, 108, 110, 112, 114, 116, 118, 120, 122 provide the structural integrity needed to hold the flexible bag body 102 upright and in the designed shape, as described in detail above.

In this embodiment, the inflatable chambers 104, 106, 108, 110, 112, 114, 116, 118, 120, 122 are integrated into and are actually part of the flexible bag body 102. For example, the flexible bag body 102 may be formed from an amorphous plastic film that is layered and thus has a first plastic film layer and a second plastic film layer. The plastic film layers of the plastic film are attached and integrated with one another in the portions of the flexible bag body 102 that form the panels 132, 134, 136, 138, and 140. However, in the portions of the flexible bag body 102 that provide the inflatable chambers 104, 106, 108, 110, 112, 114, 116, 118, 120, 122, the first plastic film layer is detached from the second plastic film layer and thus form the inflatable chambers 104, 106, 108, 110, 112, 114, 116, 118, 120, 122 that are integrated into the flexible bag body 102.

It should be noted that the closed bag bottom 128 may be sealed closed in any suitable manner. This of course may depend on the particular material(s) to form the flexible bag body 102. Nevertheless, in many embodiments involving amorphous materials (such as polyurethane plastic films), the closed bag bottom 128 may be flat sealed, gusset sealed, and/or star sealed.

Figure 2:
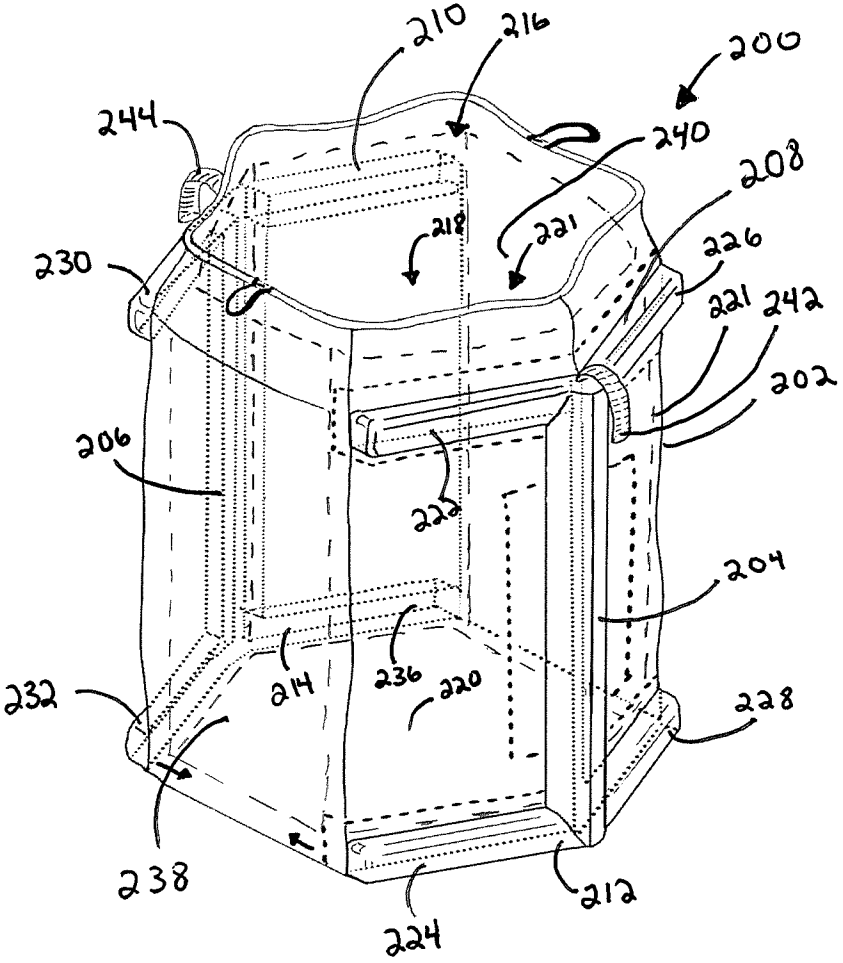
FIG. 2 illustrates another example of a trash bag in accordance with this disclosure.

FIG. 2 illustrates another exemplary trash bag 200 in accordance with this disclosure. The trash bag 200 has a flexible bag body 202 and one or more inflatable chambers. In this embodiment, the trash bag 200 includes six inflatable chambers 204, 206, 208, 210, 212, and 214. Each of the inflatable chambers 204, 206, 208, 210, 212, and 214 extends along the flexible bag body 200 so that the inflatable chambers 204, 206, 208, 210, 212, and 214 hold the flexible bag body 202 upright when the inflatable chambers 204, 206, 208, 210, 212, and 214 are inflated. In FIG. 2, the inflatable chambers 204, 206, 208, 210, 212, and 214 are shown inflated. Thus, the trash bag 200 is supported by the inflatable chambers 204, 206, 208, 210, 212, and 214 in a specific shape, which depends on the configuration of the inflatable chambers 204, 206, 208, 210, 212, and 214 along the flexible bag body 200. In this manner, the trash bag 200 does not need to be line a trash can. Instead, the inflatable chambers 204, 206, 208, 210, 212, and 214 hold the flexible bag body 202 upright and open when the inflatable chambers 204, 206, 208, 210, 212, and 214 are inflated and thus trash can easily be thrown into the trash bag 200 without further support from a trash can.

It should be noted that, while this configuration of the trash bag 200 includes the six inflatable chambers 204, 206, 208, 210, 212, and 214, different embodiments of the trash bag 200 may include any number of inflatable chambers. Furthermore, the specific configuration of the inflatable chambers 204, 206, 208, 210, 212, and 214 allow the flexible bag body 202 to take a specific shape, as explained in further detail below. However, different inflatable chambers may be provided in different configurations so that the flexible bag body 202 circumscribes an interior volume of any desired shape when the inflatable chambers are inflated.

In this embodiment, the specific shape is a cylinder. More specifically, as shown in FIG. 2, the flexible bag body 202 defines a top bag opening 216 that opens into an interior 218 of the flexible bag body 202 and a closed bag bottom 220 oppositely disposed from the top bag opening 216. In this manner, trash can be placed into the flexible bag body 202 through the top bag opening 216 and stored in the trash bag 200. Thus, maintaining the top bag opening 216 in the open position is important in order for trash to be easily placed and stored in the trash bag 200.

In this embodiment, the inflatable chambers 204, 206, 208, 210, 212, and 214, are configured to hold open the top bag opening 216 when the inflatable chambers 204, 206, 208, 210, 212, and 214 are inflated. Furthermore, the inflatable chambers 204, 206, 208, 210, 212, and 214 are configured to support the flexible bag body 202 when the inflatable chambers 204, 206, 208, 210, 212, and 214 are inflated such that the flexible bag body 202 circumscribes an interior volume 221 with a specific shape, which as mentioned above, is a cylinder.

To do this, the inflatable chamber 204 extends vertically along the flexible bag body 202. In addition, the inflatable chamber 206 extends vertically along the flexible bag body 202 and is oppositely disposed from the inflatable chamber 204. In this specific embodiment, the inflatable chamber 204 and the inflatable chamber 206 are provided on opposite vertical spines of the flexible bag body 202. In this manner, the inflatable chamber 204 and the inflatable chamber 206 provide much of the structural integrity needed to hold the flexible bag body 202 upright when the inflatable chambers 204, 206, 208, 210, 212, and 214 are inflated.

As shown in FIG. 2, the inflatable chambers 208, 210 extend horizontally along the flexible bag body 202 near the top bag opening 216 and are on opposite vertical halves of the flexible bag body 202. Similarly, the inflatable chambers 212, 214 extend horizontally along the flexible bag body 202 near the closed bag bottom 220 and are on opposite vertical halves of the flexible bag body 202. The inflatable chambers 208, 212 are a pair of inflatable chambers 208, 212 that both open into the inflatable chamber 204. In this embodiment, a top open end of the inflatable chamber 204 opens into an intermediate portion of the inflatable chamber 208 while a bottom open end of the inflatable chamber 204 opens into an intermediate portion of the inflatable chamber 212. Thus, both the inflatable chamber 208 and the inflatable chamber 212 have oppositely disposed closed ends. Accordingly, the inflatable chamber 208 forms an arm chamber section 222 that extends horizontally from a vertical side of the inflatable chamber 204 and the inflatable chamber 212 forms an arm chamber section 224 that extends horizontally from the same vertical side of the inflatable chamber 204. Furthermore, the inflatable chamber 208 forms an arm chamber section 226 that extends horizontally from the other (oppositely disposed) vertical side of the inflatable chamber 204 and the inflatable chamber 212 forms an arm chamber section 228 that extends horizontally from the same vertical side (as the arm chamber section 226) of the inflatable chamber 204.

The inflatable chambers 210, 214 are a pair of inflatable chambers 210, 214 that both open into the inflatable chamber 206. In this embodiment, a top open end of the inflatable chamber 206 opens into an intermediate portion of the inflatable chamber 210 while a bottom open end of the inflatable chamber 206 opens into an intermediate portion of the inflatable chamber 214. Thus, both the inflatable chamber 210 and the inflatable chamber 214 have oppositely disposed closed ends. Accordingly, the inflatable chamber 210 forms an arm chamber section 230 that extends horizontally from a vertical side of the inflatable chamber 206 and the inflatable chamber 214 forms an arm chamber section 232 that extends horizontally from the same vertical side of the inflatable chamber 206. Furthermore, the inflatable chamber 210 forms an arm chamber section 234 that extends horizontally from the other (oppositely disposed) vertical side of the inflatable chamber 206 and the inflatable chamber 214 forms an arm chamber section 236 that extends horizontally from the same side (as the arm chamber section 234) of the inflatable chamber 206.

Note that the inflatable chambers 204, 208, 212 are disconnected and entirely discontinuous from the inflatable chambers 206, 210, 214. Thus, the arm chamber section 222 is disconnected from the arm chamber section 230 and the arm chamber section 224 is disconnected from the arm chamber section 232. Accordingly, a panel 238 is formed between the closed distal ends of the arm chamber sections 222, 224, 230, 232. Furthermore, the arm chamber section 226 is disconnected from the arm chamber section 234 and the arm chamber section 228 is disconnected from the arm chamber section 236. Accordingly, a panel 240 is formed between the closed distal ends of the arm chamber sections 226, 228, 234, 236. When the inflatable chambers 204, 206, 208, 210, 212, 214 are inflated, the panels 238, 240 may be folded by bringing the pairs of closed distal ends of the arm chamber sections (222, 230), (224, 232), (226, 234), (228, 236) closer to one another so as to increase the circularity of the cross sectional area of the flexible bag body 202 and form a platform that helps the flexible bag body 202 stand upright.

Since the inflatable chambers 204, 208, 212 are disconnected and entirely discontinuous from the inflatable chambers 206, 210, 214, the nozzle 242 is provided to inflate the inflatable chambers 204, 208, 212 and the nozzle 244 is provided to inflate the inflatable chambers 206, 210, 214. In this case, the nozzles 242, 244 are each shaped as tubes and can be used by a human to inflate the inflatable chambers 204, 206, 208, 210, 212, 214. Each of the nozzles 242, 244 is shaped such that a user can tie the nozzles 242, 244 once the inflatable chambers 204, 206, 208, 210, 212, 214 are inflated.

As discussed above, when the inflatable chambers 204, 206, 208, 210, 212, 214 are inflated, the inflatable chambers 204, 206, 208, 210, 212, 214 provide the structural integrity that holds the flexible bag body 202 in a specific shape (e.g., the cylinder). However, when the inflatable chambers 204, 206, 208, 210, 212, 214 are deflated, the flexible bag body 202 may be shaped amorphously. In this manner, the trash bag 200 can be sold in continuous rolls of trash bags, like the trash bag 200, which is highly spatially efficient.

More specifically, the flexible bag body 202 may be formed from one or more amorphous materials such that the interior volume 221 circumscribed by the flexible bag body 202 is shaped amorphously when the inflatable chambers 204, 206, 208, 210, 212, 214 are deflated. For example, the flexible bag body 202 may be formed from one or more amorphous plastic films, such as polyurethane films. Consequently, when the inflatable chambers 204, 206, 208, 210, 212, 214 are deflated, the flexible bag body 202 takes an amorphous shape and the top bag opening 216 is not held open. However, once a user decides to use the trash bag 200, the inflatable chambers 204, 206, 208, 210, 212, 214 are inflated through the nozzles 242, 244 so that the inflatable chambers 204, 206, 208, 210, 212, 214 provide the structural integrity needed to hold the flexible bag body 202 upright and in the designed shape, as described in detail above. In this embodiment, the inflatable chambers 204, 206, 208, 210, 212, 214 are attached to (an exterior surface of) the flexible bag body 202.

It should be noted that the closed bag bottom 220 may be sealed closed in any suitable manner. This of course may depend on the particular material(s) to form the flexible bag body 220. Nevertheless, in many embodiments involving amorphous materials (such as polyurethane plastic films), the closed bag bottom 220 may be flat sealed, gusset sealed, and/or star sealed.

Figure 3:
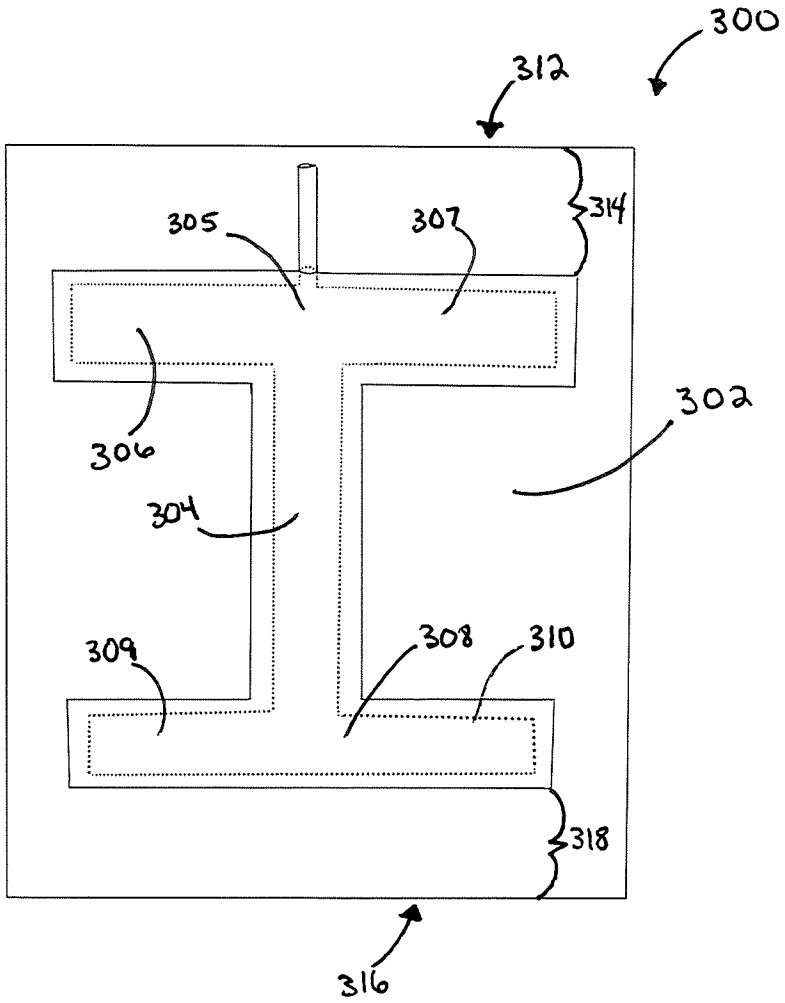
FIG. 3 illustrates an exemplary section of a trash bag with inflatable chambers attached to the exterior of the trash bag.

FIG. 3 illustrates an example of a section of a trash bag 300 (which may be the trash bag 200). The trash bag 300 has a flexible bag body 302 (which may be the flexible bag body 202). An inflatable chamber 304 (which may be either the inflatable chamber 204 or the inflatable chamber 206) extends vertically along the flexible bag body 302. The trash bag 300 includes an inflatable chamber 305 (which may be either the inflatable chamber 208 or the inflatable chamber 210) that extends horizontally across the flexible bag body 302. The inflatable chamber 305 includes an arm chamber section 306 (which may be either the arm chamber section 222 or the arm chamber section 230) and an arm chamber section 307 (which may be either the arm chamber section 226 or the arm chamber section 234) that extend horizontally from opposite vertical sides of the inflatable chamber 304.

The trash bag 300 includes an inflatable chamber 308 (which may be either the inflatable chamber 212 or the inflatable chamber 214) that extends horizontally across the flexible bag body 302. The inflatable chamber 308 includes an arm chamber section 309 (which may be either the arm chamber section 224 or the arm chamber section 232) and an arm chamber section 310 (which may be either the arm chamber section 228 or the arm chamber section 236) that extend horizontally from opposite vertical sides of the inflatable chamber 308.

As shown, the inflatable chamber 304, the inflatable chamber 305, and the inflatable chamber 308 are attached to an exterior surface of the flexible bag body 302. In one example, the inflatable chamber 304, the inflatable chamber 305, and the inflatable chamber 308 are glued to the exterior surface of the flexible bag body 302. In another example, the inflatable chamber 304, the inflatable chamber 305, and the inflatable chamber 308 are heat sealed to the flexible bag body 302. The flexible bag body 302 may be formed from an amorphous plastic film.

In this embodiment, the inflatable chamber 305 may be near a top bag opening 312 (which may be the top bag opening 216) but not exactly at the top bag opening 312. Rather, a section 314 of the flexible bag body 302 may be left above the inflatable chamber 305 to provide enough material to close the trash bag 300. Additionally, the inflatable chamber 308 may be near a closed bag bottom 316 (which may be the closed bag bottom 220) but not exactly at the closed bag bottom 316. Instead, a section 318 of the flexible bag body 302 may be left below the inflatable chamber 308 to allow the trash bag 300 to expand.

In this embodiment, the inflatable chamber 304, the inflatable chamber 305, and the inflatable chamber 308 are each attached to a surface of the trash bag 300 between the side seams of the trash bag 300. Thus, the inflatable chamber 304, the inflatable chamber 305, and the inflatable chamber 308 are attached to a flat surface of the trash bag 300 with another set of inflatable chambers (not explicitly shown), like the inflatable chamber 304, the inflatable chamber 305, and the inflatable chamber 308 attached to the opposite surface of the trash bag 300.

Figure 4:
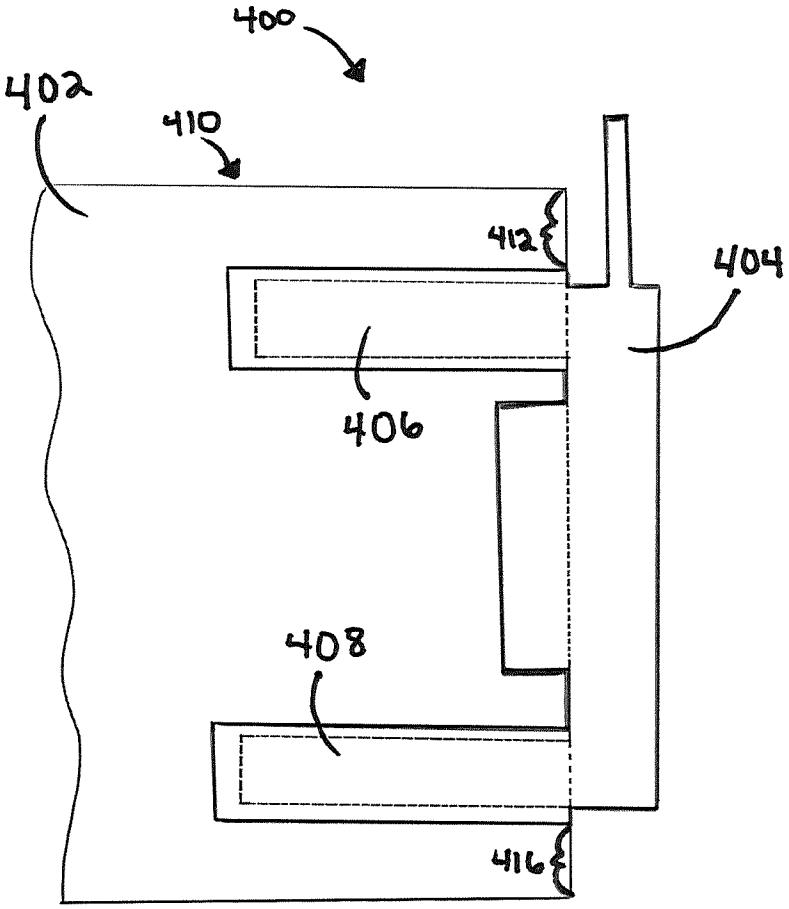
FIG. 4 illustrates another exemplary section of a trash bag with inflatable chambers attached to the exterior of the trash bag.

FIG. 4 illustrates an example of a section of a trash bag 400 (which may be the trash bag 200). The trash bag 400 has a flexible bag body 402 (which may be the flexible bag body 202). An inflatable chamber 404 (which may be either the inflatable chamber 204 or the inflatable chamber 206) extends vertically along the flexible bag body 402. Furthermore, an arm chamber section 406 (which may be either the arm chamber section 222, the arm chamber section 226, the arm chamber section 230, or the arm chamber section 234) and an arm chamber section 408 (which may be either the arm chamber section 224, the arm chamber section 228, the arm chamber section 232, or the arm chamber section 236) extend horizontally from one vertical side of the inflatable chamber 404. As shown, the inflatable chamber 404, the arm chamber section 406, and the arm chamber section 408 are attached to an exterior surface of the flexible bag body 402. In one example, the inflatable chamber 404, the arm chamber section 406, and the arm chamber section 408 are glued to the exterior surface of the flexible bag body 402. In another example, the inflatable chamber 404, the arm chamber section 406, and the arm chamber section 408 are heat sealed to the flexible bag body 402. The flexible bag body 402 may be formed from an amorphous plastic film.

In this embodiment, the arm chamber section 406 may be near a top bag opening 410 (which may be the top bag opening 216) but not exactly at the top bag opening 410. Rather, a section 412 of the flexible bag body 402 may be left above the arm chamber section 406 to allow material to close the trash bag 400. Additionally, the arm chamber section 408 may be near a closed bag bottom 414 (which may be the closed bag bottom 220) but not exactly at the closed bag bottom 414. Instead, a section 416 of the flexible bag body 402 may be left below the arm chamber section 408 to allow the trash bag 400 to expand.

In this embodiment, the inflatable chamber 404 is attached to one of the side seams of the trash bag 400. Thus, the arm chamber section 406 and the arm chamber section 408 are attached to a flat surface of the trash bag 400 with another set of arm chamber sections (not explicitly shown) extending from the opposite vertical side of the inflatable chamber 404 and attaching to the opposite flat surface of the trash bag 400. Another inflatable chamber (not explicitly shown) is attached to the opposite side seam of the trash bag 400. Furthermore, another set of arm chamber sections would extend from both vertical sides of the inflatable chamber attached to the opposite side seam and would be attached to oppositely disposed flat surfaces of the trash bag 400.

Those skilled in the art will recognize improvements and modification to the preferred embodiments of the present disclosure. All such improvements and modifications are considered within the scope of the concepts disclosed herein and the claims that follow.

What is claimed is:

1. A trash bag, comprising:

a flexible bag body defining a top bag opening that opens into an interior of the flexible bag body and a closed bag bottom oppositely disposed from the top bag opening;

a first inflatable chamber that extends vertically along the flexible bag body;

a first pair of inflatable chambers, both open into the first inflatable chamber, wherein a first one of the first pair of inflatable chambers extends horizontally near the top bag opening and forms a first arm chamber section that extends from a first side of the first inflatable chamber and a second one of the first pair of inflatable chambers extends horizontally near the closed bag bottom and forms a second arm chamber section that extends from the first side of the first inflatable chamber;

the first inflatable chamber and the first pair of inflatable chambers configured to hold the flexible bag body upright when the first inflatable chamber and the first pair of inflatable chambers are inflated;

a second inflatable chamber extending vertically along the flexible bag body and oppositely disposed from the first inflatable chamber;

a second pair of inflatable chambers both open into the second inflatable chamber, wherein a first one of the second pair of inflatable chambers extends horizontally near the top bag opening and forms a third arm chamber section that extends from a first side of the second inflatable chamber and a second one of the second pair of inflatable chambers extends horizontally near the closed bag bottom and forms a fourth arm chamber section that extends from the first side of the second inflatable chamber;

wherein the third arm chamber section extends towards the first arm chamber section but the first arm chamber section and the third arm chamber section are disconnected; and wherein the fourth arm chamber section extends towards the second arm chamber section but the second arm chamber section and the fourth arm chamber section are disconnected.

2. The trash bag of claim 1, wherein:

the first one of the first pair of inflatable chambers forms a fifth arm chamber section that extends from a second side of the first inflatable chamber oppositely disposed from the first side of the first inflatable chamber;

the second one of the first pair of inflatable chambers forms a sixth arm chamber section that extends from the second side of the first inflatable chamber;

the first one of the second pair of inflatable chambers forms a seventh arm chamber section that extends from a second side of the second inflatable chamber oppositely disposed from the first side of the second inflatable chamber;

the second one of the second pair of inflatable chambers forms an eighth arm chamber section that extends from the second side of the second inflatable chamber;

wherein the seventh arm chamber section extends towards the fifth arm chamber section but the fifth arm chamber section and the seventh arm chamber section are disconnected; and wherein the eighth arm chamber section extends towards the sixth arm chamber section but the sixth arm chamber section and the eighth arm chamber section are disconnected.

* * * * *